United States Patent [19]

Afanasiev et al.

[11] 4,272,030

[45] Jun. 9, 1981

[54] DEVICE FOR ADJUSTING AN INERTIA CONE CRUSHER DISCHARGE GAP

[76] Inventors: Mikhail M. Afanasiev, Varshavskaya ulitsa, 25, kv. 33; Nikolai A. Ivanov, Novoizmailovsky prospekt, 19, kv. 96; Evgeny A. Konstantinov, prospekt Kima, 28, kv. 220; Valery A. Makarov, Pionerskaya ulitsa, 39, kv. 17, all of Leningrad, U.S.S.R.

[21] Appl. No.: 62,129

[22] Filed: Jul. 30, 1979

[51] Int. Cl.[3] ..... B02C 2/04

[52] U.S. Cl. ..... 241/37; 241/210

[58] Field of Search ..... 241/30, 33, 36, 37, 241/207, 210

[56] References Cited

U.S. PATENT DOCUMENTS

| | | | |
|---|---|---|---|
| 3,035,782 | 5/1962 | Burbank | 241/37 X |
| 3,300,149 | 1/1967 | Lemardeley et al. | 241/36 |
| 3,305,181 | 2/1967 | Barrot et al. | 241/37 |
| 3,700,175 | 10/1972 | Saito | 241/37 |
| 3,797,759 | 3/1974 | Davis et al. | 241/37 X |
| 3,944,146 | 3/1976 | Stockmann | 241/30 |
| 4,073,446 | 2/1978 | Rundkvist et al. | 241/210 X |

*Primary Examiner*—Howard N. Goldberg

*Attorney, Agent, or Firm*—Lackenbach, Lilling & Siegel

[57] ABSTRACT

A device for adjusting an inertia cone crusher discharge gap comprises an angle sensor responsive to deflection of the breaking head axis from the vertical and generating a signal used to control an actuator providing vertical displacement of a crushing bowl of the crusher with respect to the breaking head thereof to change the size of the discharge gap. The sensor is an induction-type sensor including inductance coils connected electrically in parallel, and mounted fixedly around the breaking head and uniformly distributed along a circle having the center on the vertical axis of the crusher, and at least one permanent magnet coupled mechanically with an out-of-balance weight inducing electrical signals in said inductance coils as the out-of-balance weight is rotating.

1 Claim, 3 Drawing Figures

DEVICE FOR ADJUSTING AN INERTIA CONE CRUSHER DISCHARGE GAP

FIELD OF THE INVENTION

The present invention relates to the art of disintegrating various materials, and more particularly, to devices for adjusting an inertia cone crusher discharge gap and said device can be used in various industries, such as construction, ferrous and non-ferrous metallurgy, etc.

The invention is advantageously employed for large inertia cone crushers with the breaking head base of 1500 mm and over in diameter.

BACKGROUND OF THE INVENTION

The principle of operation of the device for adjusting a discharge gap of an inertia cone crusher is based on conversion of the angle of deflection of the crusher breaking head axis from the vertical into an electrical signal proportional to the size of the discharge gap.

Known in the art is a device for adjusting the discharge gap of an inertia cone crusher (cf. USSR Author's Certificate No. 196,536), wherein the angle sensor responsive to deflection of the breaking head axis from the vertical comprises a spring-loaded rod enclosed in a cylindrical casing and having its one end provided with a roller co-operating with the breaking head, and a rheostat-like sensitive member linked with the other end of the rod. The sensor follows up the angle of deflection of the breaking head axis from the vertical through the roller pressed against the breaking head. As soon as the angle departs from the value corresponding to the optimal crushing conditions, the sensitive member responding to the variation of the rod position sends a signal to an electric measuring unit which, in turn, generates a signal for an actuator to lift or to lower the crushing bowl and hence to change the size of the discharge gap.

The device described hereinabove is of a low reliability and has insufficient adjustment accuracy because of gradual wear of the roller moving along the breaking head surface.

Also known in the art is a device for adjusting the discharge gap of an inertia cone crusher (cf. USSR Author's Certificate No. 458,335), that comprises an angle sensor responsive to deflection of the breaking head axis from the vertical, a control and measuring means used to process and to analyze the sensor signals and to generate a control signal according to the results of this analysis, and an actuator employed to vertically displace the crushing bowl of the crusher for changing the size of the discharge gap. The breaking head is fastened to a shaft coupled mechanically with an out-of-balance weight rotated with respect to the vertical axis of the crusher by a drive with a ball spindle having a ferromagnetic coating or made completely of a ferromagnetic material.

The control and measuring means of the device comprises a signal preprocessing unit connected to the sensor output, a discharge gap setter and a comparison unit having its inputs connected to the output of the signal preprocessing unit and to the output of the discharge gap setter respectively. The actuator is electrically coupled with the output of the comparison unit.

In the device being described, the angle sensor responsive to deflection of the breaking head axis from the vertical is an inductive sensor including core-mounted inductance coils, evenly spaced, around the ball spindle in an annular holder, with the annular holder being attached to the housing of the bearing wherein the lower head of the ball spindle is installed. Every pair of inductance coils arranged oppositely are hooked into two adjacent arms of the semibridge circuit operated from a sine-wave voltage generator.

As the ball spindle rotates, the out-of-balance weight produces a centrifugal force deviating the shaft with the breaking head, mounted thereon from the vertical. The shaft drives the upper head of the ball spindle which performs a circular swinging motion, whereby the spindle approaches and moves away from the inductance coils, thus causing a variation in inductance of the coils. The transducer generates a signal depending, with the given parameters of the inductance coils, upon the size of the air gap between the core edges of these coils and the ball spindle, i.e. upon the angle of deflection of the ball spindle and, hence, upon the angle of deflection of the breaking head axis from the vertical, and said angles representing the size of the discharge gap.

A disadvantage of such prior art device is that it is difficult to compensate for the initial output voltage of the inductive sensor, increasing the control error. Furthermore, the inductive sensor is inefficient when large air gaps (over 20 mm) are set between the inductance coils and the ball spindle. It is a feature of the inductive sensor that its output signal is sharply reduced as the distance between the inductance coils and the co-operating members, that is, in this particular case the ball spindle increases, and whenever said distance is over 20 mm, the transducer signal is so weak that it is commensurable with the noise level. As a result the adjustment accuracy is insufficient. The described prior art device is, therefore, applicable only to small-size crushers with a breaking head base of not over 600 mm in diameter and with a discharge gap size of not over 30 mm. The design of such crushers enables arrangement of the inductance coils at a distance not exceeding 20 mm from the ball spindle. In large-size crushers with a diameter of the breaking head base of, say, 1750 to 2000 mm, the discharge gap can be as large as 100 mm, which corresponds to relatively large angular deflections of the breaking head axis from the vertical. The coils of the sensor in such a crusher are disposed at a greater distance from the ball spindle.

Moreover, the use of the device under consideration is restricted only to small-size crushers because the inductance coils of the sensor are arranged around the ball spindle at the level of the lower head thereof. In large-size crushers, such a mutual arrangement of the transducer and of the ball spindle hampers the installation and dismantling of the sensor since the mass of the ball spindle and of the out-of-balance weight is rather large, whereby the sensor can be damaged by the ball spindle as a result of its upset in the course of assembling and disassembling the sensor. Special means are, therefore, required to protect the sensor, that complicate the device construction.

SUMMARY OF THE INVENTION

It is an object of the present invention to provide a device for adjusting an inertia cone crusher discharge gap that ensures a higher adjustment accuracy.

Another object of the invention is to provide a device for adjusting the inertia cone crusher discharge gap that ensures a wider adjustment range.

A further object of the invention is to provide a device for adjusting the inertia cone crusher discharge gap, wherein an angle sensor responsive to deflection of the breaking head axis from the vertical should generate a stronger signal.

A still further object of the invention is to provide a device for adjusting the inertia cone crusher discharge gap, wherein an angle sensor responsive to deflection of the breaking head axis from the vertical is easily accessible for installation, inspection and repair.

With these and other objects in view, there is proposed a device for adjusting an inertia cone crusher discharge gap, said crusher comprising a breaking head fastened to a shaft coupled mechanically with an out-of-balance weight rotatable around the vertical axis of the crusher, and a crushing bowl installed above the breaking head and capable of vertical displacement with respect to the latter to change the size of the discharge gap. The device comprises an angle sensor responsive to deflection of the breaking head axis from the vertical, a signal preprocessing unit connected to the output of said angle sensor, a discharge gap setter, a comparison unit having its one input connected to the output of the signal preprocessing unit, and its other input connected to the output of the discharge gap setter and an actuator used to displace the crushing bowl with respect to the breaking head and electrically coupled with the output of the comparison unit. The angle sensor responsive to deflection of the breaking head axis from the vertical is an induction sensor including inductance coils interconnected electrically is parallel, and mounted fixedly around the shaft of the breaking head and uniformely distributed along a circle having the center on the vertical axis of the crusher, and at least one permanent magnet coupled mechanically with an out-of-balance weight for inducing electrical signals in said inductance coils as the out-of-balance weight rotates.

The advantage of the present invention resides in that the signals of the induction sensor, i.e. a generator-type sensor, have a comparatively high power (within 0.02 to 0.1 Watts) and a sufficient high signal-to-noise ratio of approximately 1000. Induction sensors have no initial voltage as compared with inductive sensors wherein an initial voltage is induced by a sine-wave voltage supplied thereto by a generator, whereas interferences are caused only by electromagnetic pick-ups effecting on the commutation conductors connecting the sensor with the signal preprocessing unit, as well as by the noise of the input network of this unit. The total level of said interference can be rather easily reduced to 1 mV. The stronger sensor output signal, having a high signal-to-noise ratio improves the adjustment accuracy of the device. Furthermore, the induction sensor output signal does not fall so sharply with an increase in the distance between the inductance coils and the co-operating element (the permanent magnet) as it takes place in the inductance sensor, hence, the induction sensor enables expansion of the adjustment range of the device.

The proposed device facilitates installation and repair of the sensor since the sensor may be disposed not necessarily around the ball spindle as in the prior art device, but also in other more convenient places along the breaking head shaft, for example, at the out-of-balance weight level.

These and other objects and advantages of the present invention will become fully apparent from the following description taken in conjunction with the accompanying drawings, wherein:

DETAILED DESCRIPTION OF THE PREFERRED EMBODIMENT

Figure 1:
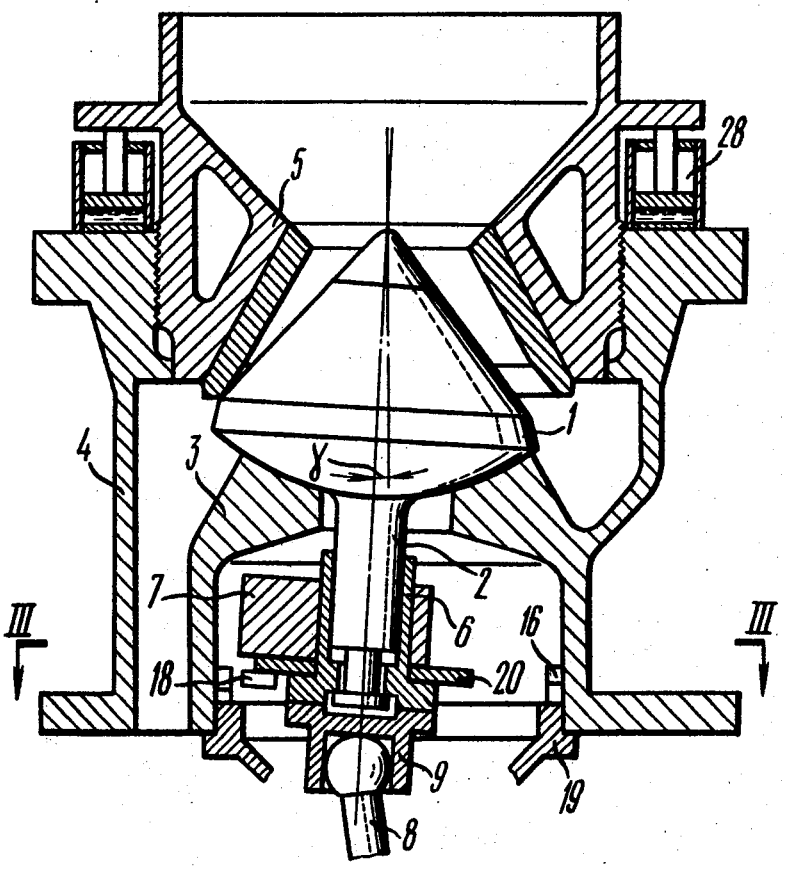
FIG. 1 is a side elevational view, in section, showing the arrangement in an inertia cone crusher of the angle sensor responsive to deflection of the breaking head axis from the vertical, which forms part of the device for adjusting an inertia cone crusher discharge gap.

Referring now to the accompanying drawings, and in particular to FIG. 1, an inertia cone crusher using the device proposed for the adjustment thereof, comprises an internal, breaking head 1 rigidly fastened to a shaft 2 and supported by a holder 3 linked with a shell 4, and a crushing bowl 5 arranged above the breaking head 1. The axis of the crushing bowl 5 being a vertical axis of the crusher.

In the initial state, when the shaft 2 is in its starting position, the axis of the shaft 2 and, hence, that of the breaking head 1 coincides with the vertical axis of the crusher. The vertical axis of the crusher and the axis of the breaking head 1 are shown in FIG. 1 by the dot-and-dash lines. The discharge gap of the crusher is formed by an external surface of the breaking head 1 and by an internal surface of the crushing bowl 5. In order to change the size of the discharge gap, the crushing bowl 5 is mounted in the shell 4 of the crusher with the capability of vertical displacement with respect to the breaking head 1.

The shaft 2 of the breaking head 1 has the lower end thereof disposed in a bushing 6, and an out-of-balance weight 7 is secured to said bushing. A drive with a ball spindle 8 is used to rotate the out-of-balance weight 7 around the vertical axis of the crusher, and the upper head of the ball spindle being pivotally mounted within a bushing 9 rigidly linked with the bushing 6.

Figure 2:
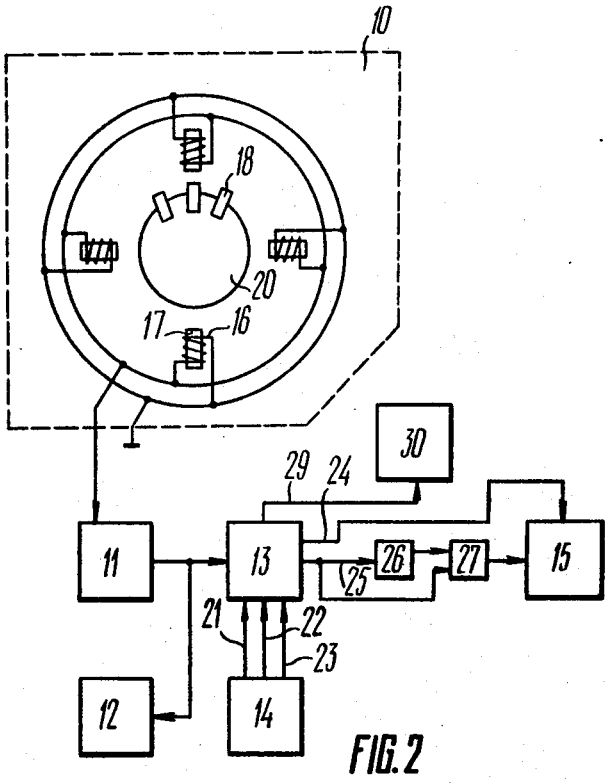
FIG. 2 is a block diagram of a device for adjusting an inertia cone crusher discharge gap.
Figure 3:
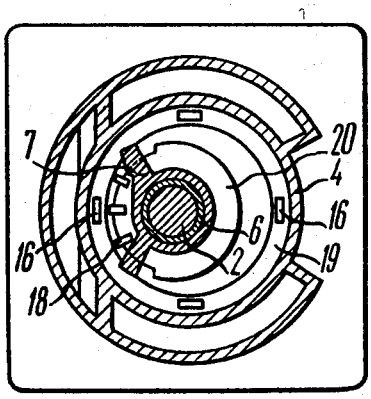
FIG. 3 is a sectional view taken on the line III—III of FIG. 1.

The device for adjusting the inertia cone crusher discharge gap comprises an angle sensor 10 (FIG. 2) responsive to deflection of the axis of the breaking head 1 (FIG. 1) from the vertical line, a signal preprocessing unit II (FIG. 2), a discharge gap size indicator 12, a comparison unit 13, a discharge gap setter 14, and an actuator 15 for a vertical displacement of the crushing bowl 5 (FIG. 1) with respect to the breaking head 1. According to the invention, the angle sensor 10 (FIG. 2) comprises inductance coils 16 wound on cores 17 (FIG. 2), and permanent magnets 18. The inductance coils 16 are interconnected electrically in parallel and are arranged around the shaft 2 (FIG. 1) of the breaking head 1 on a fixed supporting ring 19 secured to the lower portion of the shell 4 of the crusher. As shown in FIG. 3, the coils 16 are uniformly distributed along a circle having its center on the vertical axis of the crusher. An isolation diode may be connected in series with every inductance coil 16. The permanent magnets 18 are installed, for example, on a disc 20 rigidly fastened to the out-of-balance weight 7.

As shown in FIGS. 1 and 3, the axes of the inductance coils 16 are directed along the radii of a circle lying in a horizontal plane and having the center on the vertical axis of the crusher, while the permanent magnets 18 are arranged substantially at the same level as the inductance coils 16 to induce the maximum e.m.f. as the out-of-balance weight 7 rotates together with the disc 20. However, the inductance coils 16 may be installed so that the axes thereof are directed tangentially with respect to said circle or parallel to the vertical axis of the crusher. In the latter case, the permanent magnets 18 should be arranged slightly higher than the inductance coils 16 to provide an optimum magnetic coupling therebetween.

In the embodiment of the invention being described, the angle sensor 10 (FIG. 2) incorporates four inductance coils 16 and three permanent magnets 18. However, the indicated numbers of these elements are not critical. Any other number of the permanent magnets 18 may be used instead of the three specified and shown, including one permanent magnet 18. In a similar fashion, the number of the inductance coils 16 may differ from four. A larger number of the inductance coils 16 provides a more complete information on the nature of motion of the axis of the breaking head 1 (FIG. 1) during the rotation of the out-of-balance weight 7. The required number of the inductance coils 16 and of the permanent magnets 18 is defined, with given parameters of these elements and a given frequency of rotation of the out-of-balance weight 7, by the needed number of the output signals of the angle sensor 10 (FIG. 2) per revolution of the out-of-balance weight 7 (FIG. 1), i.e., by the desired value of a mean output signal of the angle sensor 10 (FIG. 2). Thus, if the device is used in an inertia cone crusher with a breaking head base of 1750 mm in diameter and the out-of-balance weight rotating at a frequency of 8 Hz, the four inductance coils and the three permanent magnets provide a mean sensor output signal of approximately 2 Volts.

Leads of the inductance coils 16 forming the output of the angle sensor 10 are connected to the input of the signal preprocessing unit 11 which may be embodied for example, as an integrator if the signals are further processed in analog form, or as an integrator with an analog-to-digital converter if the signals are further processed in digital form. The circuitries of such elements as well as those of the successive units of the device are well known to those skilled in the art and, therefore, have not been included in the present specification or in the drawings. The output of the signal preprocessing unit 11 is connected with a data signal input of the comparison unit 13 and with an input of the discharge gap size indicator 12 which may be, for example, a conventional pointer or digital indicator calibrated in units of the discharge gap, i.e. in millimeters.

The comparison unit 13 is provided also with three reference signal inputs connected respectively with three outputs 21, 22, and 23 of the discharge gap setter 14. At these inputs are developed, respectively, a signal corresponding to the minimum gap size, a signal corresponding to the maximum gap size, and an emergency signal. An emergency arises, for example, whenever uncrushable solids are in the crusher or the crusher works without any material, and is characterized by a considerable increase in the angle of deflection of the axis of the breaking head 1 (FIG. 1) from the vertical.

An output 24 (FIG. 2) of the comparison unit 13 is connected directly to the actuator 15. Another output 25 is connected to the same actuator via a delay element 26 and an AND gate 27. The actuator 15 incorporates, for example, hydraulic cylinders 28 (FIG. 1), an electric motor-operated oil pump, and a suitable control circuit. In order not to complicate the drawings, the oil pump, the electric motor and the control circuit of the hydraulic cylinders 28 are ommitted in FIGS. 1 and 2. The rods of the hydraulic cylinders 28 are linked with the crushing bowl 5 to provide the lifting and lowering thereof. The delay element 26 (FIG. 2) and the AND gate 27 are used to prevent the operation of the actuator 15 in response to a reduction in the gap size, caused by random pulses of short duration. An output 29 of the comparison unit 13 is connected to a drive 30 of the crusher. Amplifiers may be inserted between the outputs 24, 25, and 29 of the comparison unit 13 and devices controlled by this unit.

It is obvious that the emergency signal is not generally necessary for the operation of the proposed device, and if this signal is not employed, then the respective output 23 of the discharge gap setter 14 can be eliminated. The input of the comparison unit 13, connected with said output and its output 29 connected to the drive 30 of the crusher are also not necessary in such a case.

It is also apparent that the discharge gap setter 14 may have only one output 22, i.e. the output of the signal representing the maximum gap size. In this case, the comparison unit 13 will also have only one output 25 for a gap reduction control signal, and the control circuit of the actuator 15 should include elements for switching off the actuator 15 upon expiration of a certain time required for the crushing bowl 5 (FIG. 1) of the crusher to lower as much as it is necessary for the discharge gap to meet the optimum conditions of crushing.

The adjusting device operates as follows.

Before operation, the minimum size of the discharge gap is set by means of the actuator 15 (FIG. 2) depending upon the physical and mechanical characteristics of the material to be disintegrated and upon type and size of the crusher. The crusher is then loaded with the material, and the drive 30 of the crusher is switched on, the rotation of the ball spindle 8 (FIG. 1) being imparted via the bushings 9 and 6 to the out-of-balance weight 7 developing a centrifugal force that causes the axis of the shaft 2, i.e. the axis of the breaking head 1, to precess about the vertical at an angle $\gamma$. The value of the angle $\gamma$ is a measure of the size of the discharge gap for a given material. The permanent magnets 18 rotating together with the out-of-balance weight 7 pass in the vicinity of the inductance coils 16 and induce electrical signals therein. With given parameters of the inductance coils 16 and those of the permanent magnets 18 the value of these signals depends upon the speed of the permanent magnets 18 moving with respect to the coils 16 and upon the minimum distance at which the magnets 18 pass the coils 16.

A train of electrical signals from the inductance coils 16 is fed to the input of the signal preprocessing unit 11 (FIG. 2) performing, for example, the functions of amplification, conversion of a discrete signal into an analog one (integration), suppression of high-frequency signal components and separation of components at frequencies not exceeding the frequency of rotation of the out-of-balance weight 7 (FIG. 1) and, further, conversion of the signal into a form convenient for subsequent use, for example, into a digital form.

From the output of the signal preprocessing unit 11 (FIG. 2), the signal is applied to the discharge gap size indicator 12, the reading of the indicator 12 corresponding to the set size of the gap. The output signal of the signal preprocessing unit 11 may be measured by any instrument, for example, by a voltmeter, then a signal of the same value is set at the output 21 of the discharge gap setter 14. This signal is taken as a signal representing the minimum size of the discharge gap.

Thereupon the crusher is switched off and the crushing bowl 5 (FIG. 1) is lifted to a level corresponding to the maximum size of the discharge gap for this type and size of crusher. The crusher is again loaded with the material, the drive 30 (FIG. 2) is switched on and the method described hereinabove is used to calibrate the gap size indicator 12 (FIG. 2) and to set at the output 22 of the discharge gap setter 14 the signal representing the maximum size of the discharge gap. Furthermore, the emergency signal exceeding the signal at the output 22 of the discharge gap setter 14 by, say, 20 to 30 percent is set at its output 23.

Once these preparatory steps are performed, the crushing bowl 5 (FIG. 1) is again lowered down to the minimum size of the gap. Thus, the crusher is prepared for work with the given material.

During the crusher operation, the signal from the output of the signal preprocessing unit 11 (FIG. 2) is compared in the comparison unit 13 with the reference signals supplied by the discharge gap setter 14. Should the signal at the output of the signal preprocessing unit 11 be weaker than that representing the maximum size of the gap and be stronger than that representing the minimum size of the gap, no signals appear at the outputs 24, 25, and 29 of the comparison unit 13. This means that the discharge gap is within the required limits and need not be adjusted.

If in course of crusher operation the discharge gap increases beyond the maximum permissible size, for example, because of wear of the working surfaces of the breaking head 1 (FIG. 1) and of the crushing bowl 5, the angle $\gamma$ of deflection of the axis of the breaking head 1 from the vertical thus also increases, this, in turn, causing an increase in signals delivered from the inductance coils 16. The output signal of the signal preprocessing unit 11 (FIG. 2) will exceed the signal representing the maximum gap size, supplied from the output 22 of the discharge gap setter 14, and a gap reduction control signal will thus appear at the output 25 of the comparison unit 13. This signal propagating via the delay element 26 and the AND gate 27 switches on the electric motor of the actuator 15, resulting in the hydraulic cylinders 28 (FIG. 1) lowering the crushing bowl 5 of the crusher to reduce the discharge gap.

As the discharge gap is being reduced, the angle $\gamma$ and the signals from the inductance coils 16 are also reduced. Once the discharge gap attains the minimum size, the output signal of the signal preprocessing unit 11 (FIG. 2) becomes equal to the signal supplied from the output 21 of the discharge gap setter 14 and representing the minimum size of the gap, whereby at the output 24 of the comparison unit 13 a control signal appears which switches off the electric motor of the actuator 15 to discontinue the lowering of the crushing bowl 5 (FIG. 1).

If the angle $\gamma$ is increased excessively, for example, because of the absence of the material in the crusher or because of the presence of uncrushable solids therein, the output signal of the signal preprocessing unit 11 (FIG. 1) exceeds the signal supplied from the output 23 of the discharge gap setter 14, and a signal appears at the output 29 of the comparison unit 13 along with the control signal at the output 25 of the same unit. This signal is applied to the drive 30 of the crusher and switches it off. Due to the provision of the delay element 26 and of the AND gate 27, the crusher will be switched off before the control signal from the output 25 of the comparison unit 13 arrives at the actuating mechanism 15.

The device proposed expands the adjustment range by 70 mm as compared with known prior art devices and improves the adjustment accuracy.

While a prepared embodiment of the invention has been shown and described, various modifications thereof will be apparent to those skilled in the art and therefore it is not intended that the invention be limited to the disclosed embodiment or to any and all modifications or details thereof and the departures which may be made therefrom shall be considered to come within the scope of the invention as defined in the following claims.

What is claimed is:

1. A device for adjusting a discharge gap in an inertia cone crusher comprising a breaking head having a shaft, an out-of-balance weight coupled mechanically with said shaft and rotatable around the vertical axis of said crusher, and a crushing bowl installed above said breaking head and capable of vertical displacement with respect to the latter so as to change the size of said discharge gap, said device including:

an angle sensor, responsive to a deflection of the axis of said breaking head from the vertical, having an output, said sensor being an induction sensor comprising a plurality of inductance coils interconnected electrically in parallel, said induction coils being mounted fixedly around said shaft of said breaking head and uniformly distributed along a circle having the center thereof on the vertical axis of said crusher, and at least one permanent magnet coupled mechanically with said out-of-balance weight for inducing electrical signals in said inductance coils as said out-of-balance weight rotates;

a signal preprocessing unit having an input and an output, said input of said signal preprocessing unit being connected with said output of said angle sensor;

a discharge gap setter having an output, and being adapted for generating a signal determining the maximum permissible size of the discharge gap when said cone crusher is applied to a certain material;

a comparison unit having first and second inputs and an output, said first input of said comparison unit being connected with said output of said signal preprocessing unit, and said second input of said comparison unit being connected with said output of said discharge gap setter; said comparison unit responding to an excess of said maximum permissible size of the discharge gap, determinable by a signal from said discharge gap setter; and an actuator electrically coupled with said output of said comparison unit and adapted for vertically displacing said crushing bowl with respect to said breaking head when the size of said maximum permissible discharge gap has been exceeded.

* * * * *